US005179394A

United States Patent [19]

Hoshino et al.

[11] Patent Number: 5,179,394

[45] Date of Patent: Jan. 12, 1993

[54] NOZZLELESS INK JET PRINTER HAVING PLATE-SHAPED PROPAGATION ELEMENT

[75] Inventors: Masaru Hoshino; Masanori Tanizaki; Tsutomu Nishiwaki, all of Nagano, Japan

[73] Assignee: Seiko Epson Corporation, Tokyo, Japan

[21] Appl. No.: 616,039

[22] Filed: Nov. 20, 1990

[30] Foreign Application Priority Data

| | | | |
|---|---|---|---|
| Nov. 21, 1989 | [JP] | Japan | 1-304446 |
| May 8, 1990 | [JP] | Japan | 2-118431 |
| May 8, 1990 | [JP] | Japan | 2-118432 |
| Sep. 17, 1990 | [JP] | Japan | 2-246524 |

[51] Int. Cl.[5] ..... B41J 2/04

[52] U.S. Cl. ..... 346/140 R; 310/313 R

[58] Field of Search ..... 346/140 R, 75; 310/313 R, 313 A, 313 B, 322, 323, 327; 118/624, 626

[56] References Cited

U.S. PATENT DOCUMENTS

| | | | |
|---|---|---|---|
| 2,512,743 | 6/1950 | Hansell | 346/75 X |
| 3,739,393 | 6/1973 | Lyon | 346/75 |
| 4,063,198 | 12/1977 | Wagers et al. | 333/30 R |
| 4,287,522 | 9/1981 | Meyer | 346/75 |
| 4,308,547 | 12/1981 | Lovelady et al. | 346/140 R |
| 4,684,328 | 8/1987 | Murphy | 417/322 |
| 4,697,195 | 9/1987 | Quate et al. | 346/140 R |
| 4,751,534 | 6/1988 | Elrod et al. | 346/140 R |
| 4,768,256 | 9/1988 | Motoda | 310/323 X |
| 4,830,872 | 5/1989 | Grenfell | 427/30 |
| 4,931,752 | 6/1990 | Bray et al. | 333/151 |
| 5,063,396 | 11/1991 | Shiokawa | 346/140 R |

FOREIGN PATENT DOCUMENTS 0387863 3/1990 European Pat. Off. .

*Primary Examiner*—Joseph W. Hartary

*Attorney, Agent, or Firm*—Sughrue, Mion, Zinn, Macpeak & Seas

[57] ABSTRACT

In a nozzleless ink jet printer, a plate-shaped propagation element for propagating a surface acoustic wave is fixedly mounted on a substrate which is arranged along the platen and has an ink pooling groove, and the ink led to the edge of the propagation element from the ink pooling groove by surface tension is caused to jet in the form of ink mist by surface acoustic waves generated by excitation of comb-shaped interleaved electrodes so as to record images such as characters and patterns on a recording sheet.

23 Claims, 17 Drawing Sheets

FIG. 4(a)
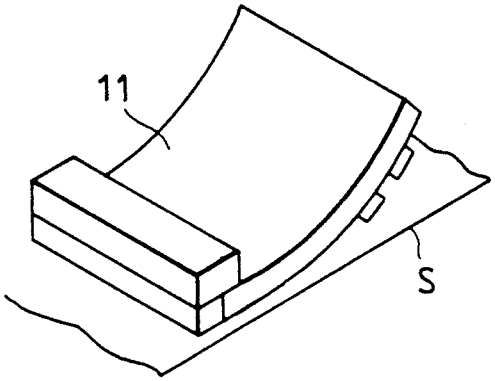
FIG. 4(b)
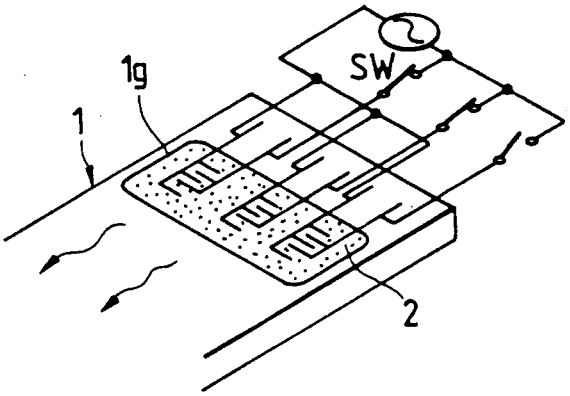
FIG. 4(c-1)
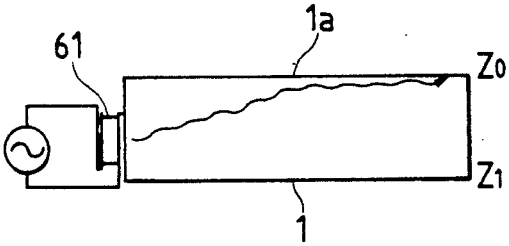
FIG. 4(c-2)
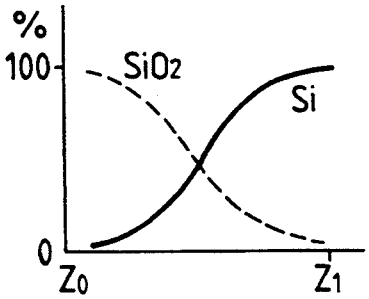
FIG. 4(c-3)
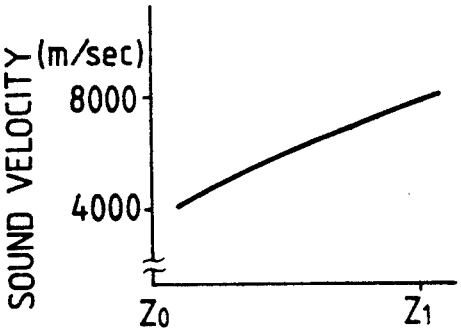

FIG. 5(a)
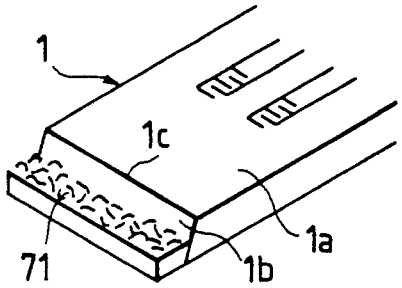
FIG. 5(b)
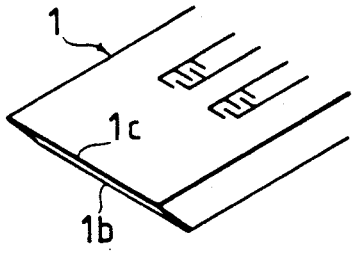
FIG. 5(c)
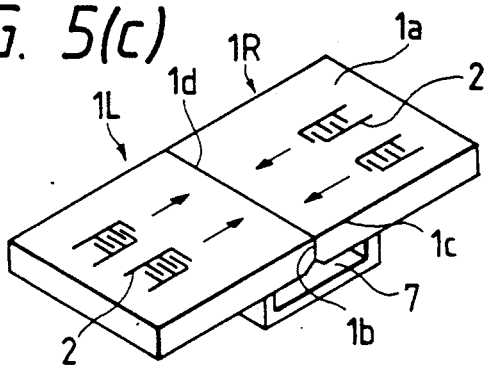
FIG. 5(d)
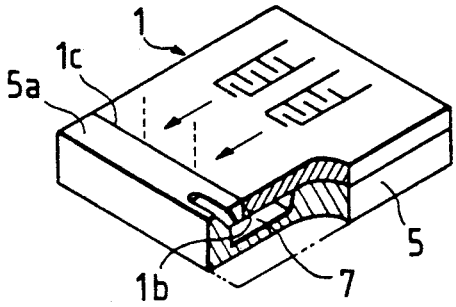
FIG. 5(e)
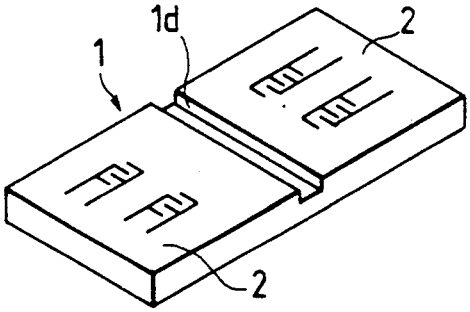
FIG. 5(f)
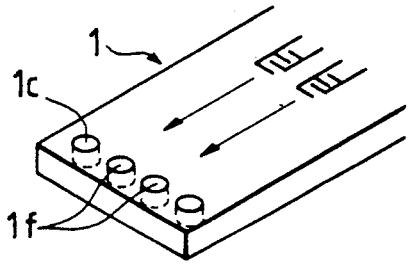
FIG. 5(g)
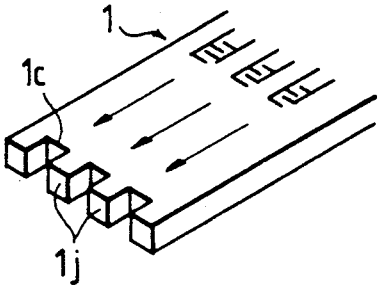
FIG. 5(f-1)
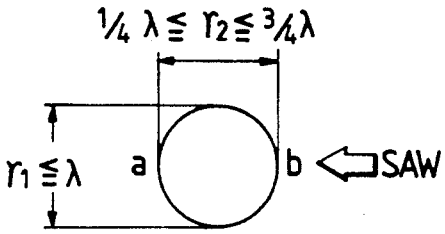

FIG. 11(a-1)
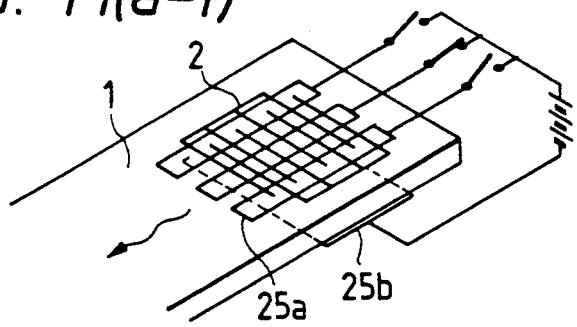
FIG. 11(a-2)
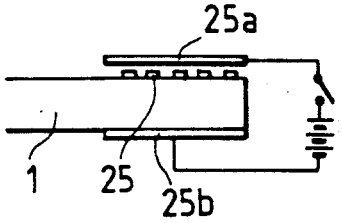
FIG. 11(b-1)
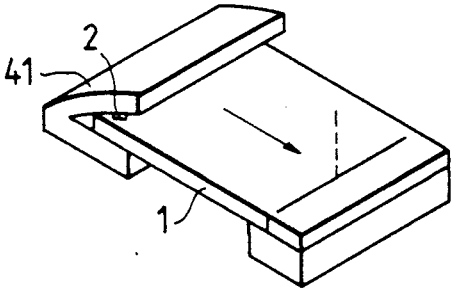
FIG. 11(b-2)
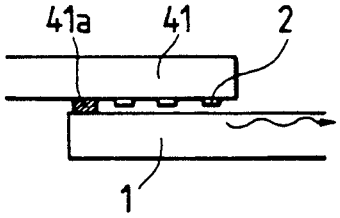
FIG. 11(c-1)
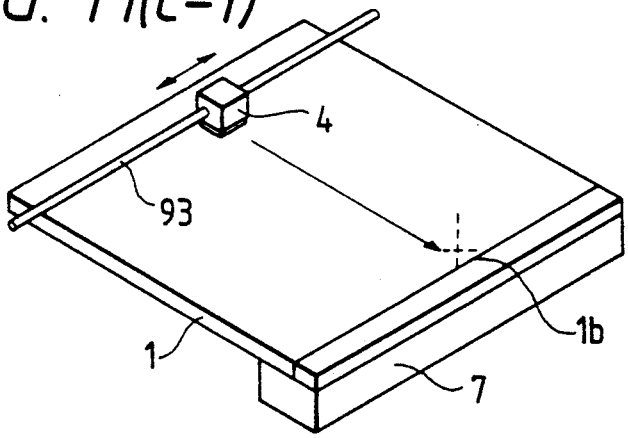
FIG. 11(c-2)
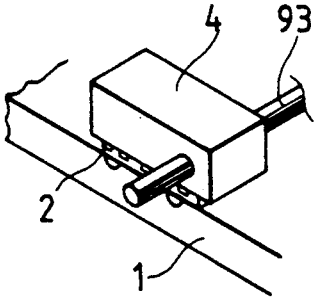
FIG. 11(d-1)
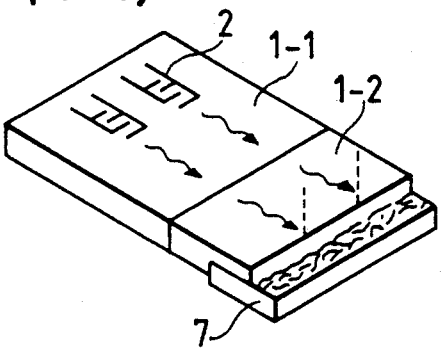
FIG. 11(d-2)
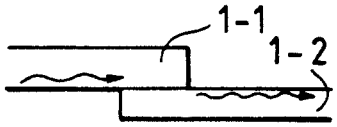
FIG. 11(d-3)
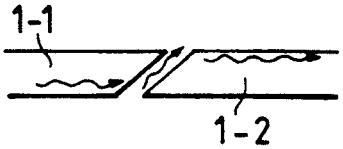

FIG. 12(a-1)
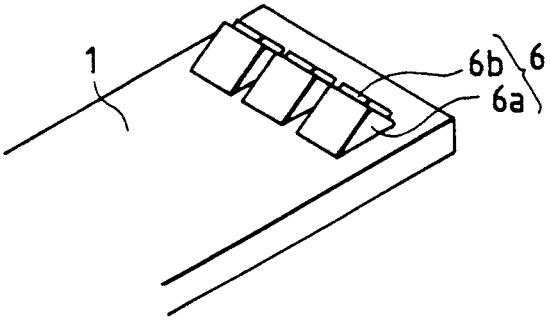
FIG. 12(a-2)
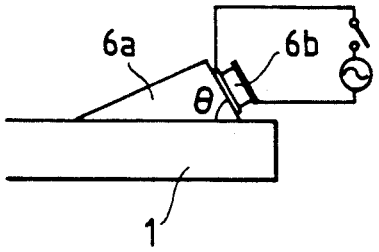
FIG. 12(b)
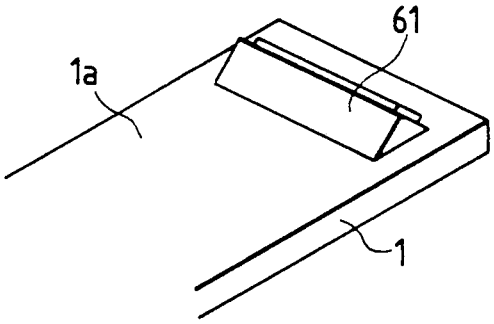
FIG. 12(c-1)
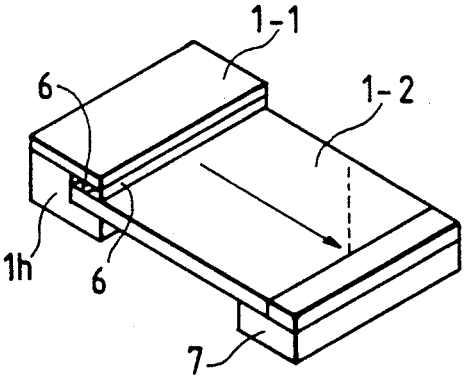
FIG. 12(c-2)
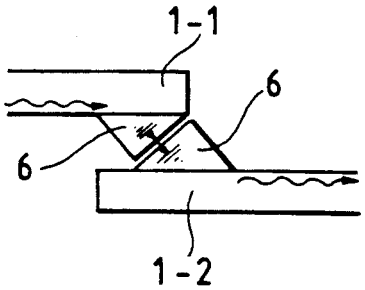

NOZZLELESS INK JET PRINTER HAVING PLATE-SHAPED PROPAGATION ELEMENT

BACKGROUND OF THE INVENTION

The present invention relates to a nozzleless ink printer in which surface acoustic waves are utilized to cause ink to be jetted in the form of mist.

In an ink jet printer, ink droplets are jetted to record characters or patterns on the recording sheet according to input data. Thus, the ink jet printer is advantageous in that it is noiseless, and data can be recorded directly on ordinary sheets of paper. However, the ink jet printer is still disadvantages in the following points.

It is necessary to provide a number of ink pressurizing chambers and bubble forming chambers for a small printing head, and to connect a number of nozzles to those chambers with high density. Hence, in the manufacture of the ink jet printer, the molding technique must be considerably high in precision, which obstructs reducing the manufacturing cost. Furthermore, because of the drying of ink or the deposition of dust, the nozzles are liable to be clogged. Thus, the ink jet printer is relatively low in reliability.

In order to overcome the above-described difficulties, recently intensive research has been conducted on an ink ejector utilizing surface acoustic waves.

Japanese Unexamined Published Patent Applications Nos. 10731/1978 and 14881/1981 disclose the first ink ejectors of a type in which surface acoustic waves are utilized to jet or transfer a liquid. However, those devices suffer from the same problems as the ink jet printer because they require nozzles and liquid flow paths.

U.S. Pat. No. 4,697,195 discloses a device in which a number of pairs of comb-shaped electrodes are formed concentrically on the surface of a piezoelectric substrate held immersed in solution, and high frequency voltage is applied to those electrodes to generate surface acoustic waves on the surface of the piezoelectric substrate. Conical leakage vertical oscillations induced by the surface acoustic waves thus produced are concentrated at the solution level to jet solution droplets onto the recording medium. This device is epoch-making in that it uses no nozzles to jet solution droplets. However, in view of its construction, it is considerably difficult to realize the multi-element print which is required for providing the device as an actual printer.

The ink jet system disclosed in the publication "Japan Acoustic Society Lecture Papers", March 1989, by Shoko Shiokawa et al. is based on the phenomenon that, when a liquid droplet is placed on the propagating surface of a surface acoustic wave, the liquid is caused to flow in the direction of propagation by the surface acoustic wave excited therein, and a liquid-mist consisting of liquid particles is jetted from the other side of the liquid droplet. The ink jet system is significant for realizing a nozzleless printer. However, the system is still disadvantageous in that, as was pointed out in the publication, the flow of the liquid is liable to be affected by the condition of the surface of the substrate, and depending on the quantity of the liquid droplet the surface curvature is changed or the propagation path in the liquid is shifted, and therefore it is impossible to correctly control the direction of the ink mist discharged from the liquid droplet's surface.

SUMMARY OF THE INVENTION

In view of the foregoing, an object of this invention is to provide a nozzleless ink jet printer which can accurately jet liquid droplets to a recording medium without nozzles.

For this purpose, provided according to the invention is a nozzleless ink jet printer in which ink is supplied to the edge of a propagation element in which a surface acoustic wave is propagated, and the ink thus supplied is caused to jet from the edge in a predetermined direction by the energy of the surface acoustic wave.

Furthermore, in the nozzleless ink jet printer according to the invention, the surface tension induced at the end face of the propagation element is utilized to hold ink in the form of a film on the edge of the latter.

Moreover, in the nozzleless ink jet printer of the invention, in order to jet ink mist from the selected parts of the edge of the propagating element according to a given recording signal, a number of surface acoustic wave generating means are arranged on the propagating surface of the propagation element.

The nature, principle and utility of the invention will become more apparent from the following detailed description when read in conjunction with the accompanying drawings.

BRIEF DESCRIPTION OF THE DRAWINGS

In the accompanying drawings:

FIGS. 4(*a*) through 4(*c*1) are diagrams showing examples of the propagation element in the printer according to the invention, and FIGS. 4(*c*-2) and 4(*c*-3) are graphical representations indicating characteristic component with sound velocity;

FIGS. 5(*a*) through 5(*g*) and 5(*f*-1) are diagrams showing examples of the end face of the propagation element;

FIG. 1 (*a*-1) through FIG. 12(*c*-2) are diagrams showing various examples of SAW generating devices in the printer according to the invention;

DESCRIPTION OF THE PREFERRED EMBODIMENTS

Prior to describing in detail the preferred embodiments of the invention, an ink mist jetting principle in a nozzleless ink jet printer according to the invention will be described with reference to FIG. 2.

Figure 2A:
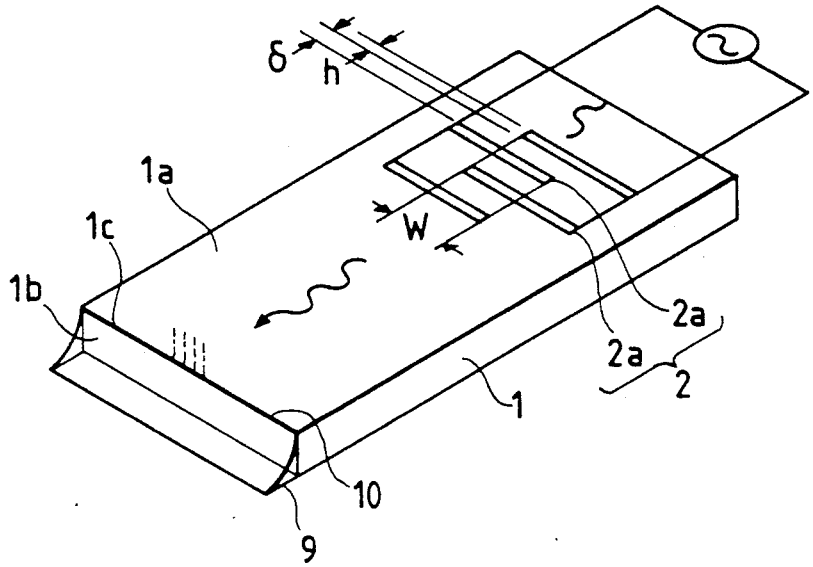
FIGS. 2(*a*) and (*b*) are explanatory diagrams for a description of the fundamental design of a printing head and an ink mist jetting principle in the printer according to the invention.
Figure 2B:
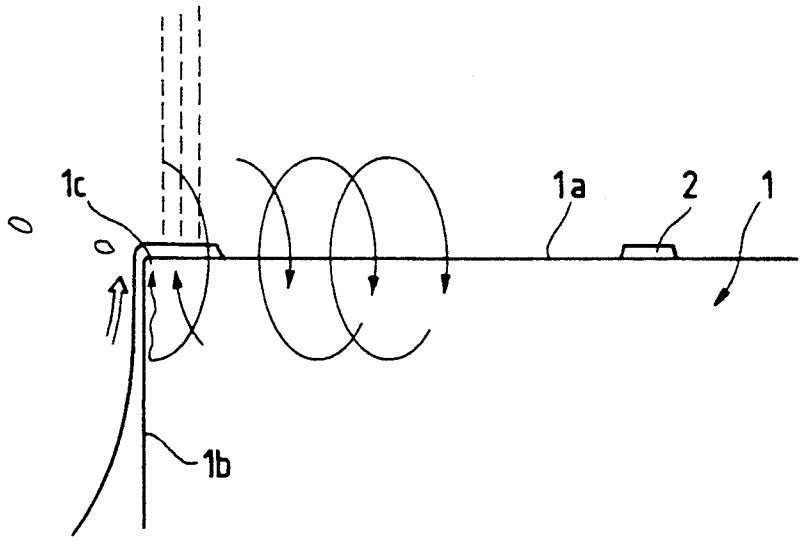

In FIG. 2, reference numeral 1 designates a plate-shaped propagation element composed of a piezoelectric single crystal whose one surface is made flat to form a surface acoustic wave propagating surface 1*a*. A comb-shaped interdigital transducer (hereinafter referred to merely as "an IDT" when applicable) 2 forming an elastic surface wave resonator is formed, for instance, by photolithography, on one half of the propagating surface 1*a*. The propagation element 1 has an end face 1*b* which forms a discontinuous propagation edge 1*c* with the propagating surface 1*a*. The surface tension of the edge 1*c* is utilized to hold ink in the form of a film in the region of the edge 1*c*.

When a voltage having a frequency f is applied to electrode arrays 2*a* adjacent to one another in the IDT 2 thus formed, then a surface acoustic wave (hereinafter referred to merely as "an SAW" when applicable) having a wavelength of $2(\delta+h)$ is produced with a width W corresponding to the overlap of adjacent electrode arrays 2*a* and 2*a* which wave satisfies the following equation:

$$f=v/2(\delta+h)$$

where h is the width of each electrode array 2*a*, 67 is the distance between electrode arrays 2*a*, and v is the propagation velocity (or phase velocity). The SAW thus produced reaches the discontinuous propagation edge 1*c*, advancing in one direction.

On the other hand, held on the end face 1*b* which forms an angle with the propagating surface 1*a* at one end of the propagation element 1 is the ink led below the edge 1*c* from the ink pool by the surface tension of the end face 1*b*.

A part of the SAW propagating along the propagating surface 1*a*, while describing ellipses in a direction opposite to the direction of advancement, upon arrival to the end face 1*b*, propagates upwardly towards the edge 1*c* shown in FIG. 2(*b*) to draw the ink held on the end face 1*b* to the propagating surface 1*a* near the edge 1*c* thus forming a film of ink there. On the other hand, the larger part of the SAW reflected from the end face 1*b* cancels out the lateral components of the SAW propagating towards the end face 1*b* while describing ellipses, thus allowing only the vertical components of the SAW to remain. The vertical components push the film of ink formed on the propagating surface 1*a* upwardly into a mist of ink 2.5 to 60 μm in particle size, which flows upwardly, or in a direction substantially perpendicular to the propagating surface 1*a*, with a width W substantially equal to the overlap of the electrode arrays 2*a*.

Figure 1:
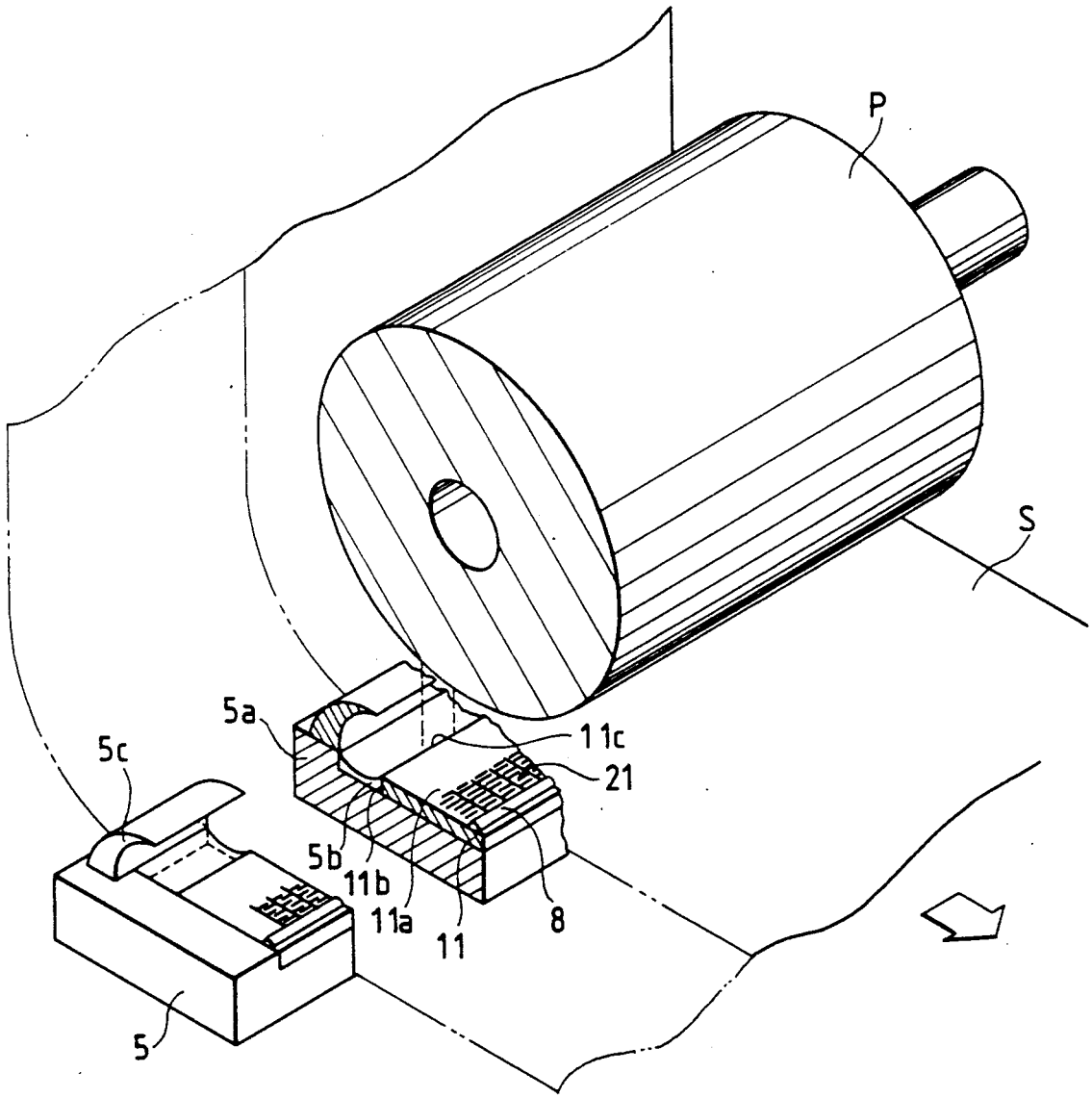
FIG. 1 is a perspective view, with parts cut away, showing a first embodiment of this invention, a typical example of a nozzleless ink jet printer.

FIG. 1 shows a typical embodiment of the invention, in the form of a nozzleless ink jet printer for a line printer, constructed according to the above-described fundamental principal of the invention.

In FIG. 1, reference numeral 11 designates an elongated plate-shaped propagation element which is longer than an effective printing region. The propagation element is made of a $LiNBO_3$ 128° Y-cut piezoelectric crystal plate. The propagation element has a mirror-finished surface, namely, a propagating surface 11*a*. Provided on one end portion of the propagation surface are a number of pairs of comb-shaped electrodes, or IDTs 21, which are formed by photolithography or the like and which excite SAWs in the respective waveguide independently. A damping element 8 is provided behind the IDT 21 to absorb SAWs propagating in the opposite direction.

Further in FIG. 1, reference numeral 5 designates a substrate made of a thermally conductive material such as aluminum which is positioned along a platen P. The above-described propagation element 11 is fixedly mounted on one side portion of the surface of the substrate 5 confronting with platen P. A bank 5*a* is formed on one side of the propagation element 11, i.e., on the side of the end face 11*b* which forms a discontinuous propagation edge 11*c*. The bank 5*a* and the end face 11*b* defines an ink pooling groove 5*b*.

When, in the ink jet printer thus constructed, a high frequency voltage is applied to one or plural pairs of comb-shaped electrodes (IDTs 21) selected by a recording signal, SAWs are formed on the waveguides corresponding to the IDTs 21. Each of e SAWs thus formed propagates along the propagating surface 11*a* towards the edge 11*c* to excite the ink led to the region of the edge 11*c* by surface tension, so that a mist of ink, or a group of ink droplets 2.5 to 60 μm in particle size, is shot upwardly from the edge 11*c* toward a recording sheet S on the platen P. Thus, a number of ink particles are jetted, as picture elements, onto the recording sheet S, to form a character or pattern corresponding to the recording signal.

According to experiments, the quantity of mist jetted onto and adhered to the recording sheet S is proportional to the period of time of application of the high frequency voltage to the IDTs 21. When the period of time of application of high frequency voltage is short, as shown in FIG. 21(*a*), the resultant picture element is low in particle density. When it is long, as shown in FIG. 21(*c*), the resultant picture element is high in particle density. This means that the conventional ink jet system forming one picture element with one ink droplet (FIG. 21(*d*)) cannot record an image in gradation, whereas with the invention an image high in gradation can be formed by controlling the period of time of application of high frequency voltage. It has been found through experiments that the inventive technique can realize up to 256 different half-tones. In order to realize these half-tones, high frequency voltage was applied in two ways, continuously and intermittently; more specifically, the high frequency voltage was applied continuously to record an image high in density, and it was applied intermittently to record an image low in density, with the result that the images could be formed quickly, and the energy applied per unitary time could be minimized.

In this case, ink droplets 101 jet obliquely forwardly of the edge 1*c* together with the mist of ink (FIG. 2(*b*)). The reason for this may be the resonance due to the difference in natural oscillation frequency between the propagation element 1 and the ink at the end face 1*b* that is, between solid and liquid. Such large ink droplets not suitable for recording are caught by a gutter member 5*c* arranged in front of the propagation element 11 so that they are returned into the ink pooling grooves 5*b* (FIG. 1). During recording, heat is generated in the propagation element 11; however, it is radiated into the frame member or the air through the substrate 5 conductive substrate 5.

Figure 3A:
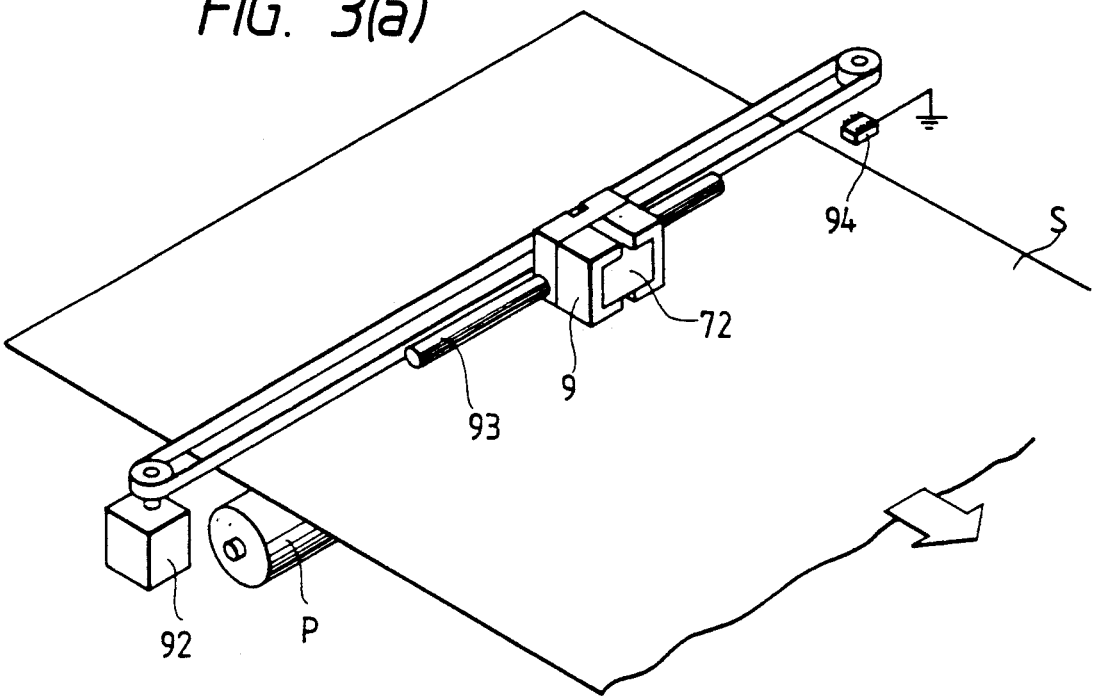
FIG. 3(*a*) is a perspective view outlining a nozzleless ink jet printer of carriage type of another embodiment of the invention, and FIGS. 3(*b*) and 3(*c*) are sectional views of essential components of the printer.
Figure 3B:
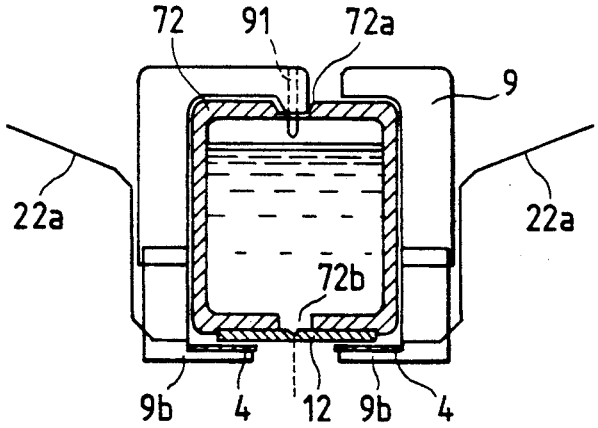
Figure 3C:
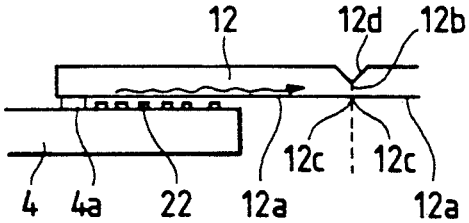

FIG. 3 shows a second embodiment of the invention, a carriage type nozzleless ink jet printer in which the printing head is moved in the main scanning direction The major specific feature of the second embodiment resides in that the propagation element which is liable to be damaged can be replaced together with an ink cartridge.

In FIG. 3, reference numeral 72 designates a box-shaped ink cartridge molded from synthetic resin. The top 72*a* of the ink cartridge 72 is small in thickness, so that, when the cartridge is mounted on a carriage 9, an air discharging hole is formed in the top 72*a* by a protrusion 91 extending from the carriage 9. The bottom of the ink cartridge 72 has an opening 72*b* which is covered with a propagation element 12 (described later).

The propagation element 12 is made of a piezoelectric single crystal in its entirety, or it can be made of a ceramic plate having a film of piezoelectric signal crystal on its portion confronting with the IDTs 22. As shown in FIGS. 3(*b*) and 3(*c*), a V-groove 12*d* is formed in the upper surface of the propagation element 12 which confronts with the opening 72*b* of the ink cartridge 72 in such a manner that it extends perpendicular to the direction of movement. The V-groove 12*d* has a crack 12*b* extending to the lower surface, namely, a propagating surface 12*a*. The capillary action of the crack 12*b* is utilized to supply ink to the region of the edge 12*c* and hold it there.

The carriage 9, which is arranged so as to move along the platen P in the main scanning direction, has right and left propagation element supporting plates 9*b* and 9*b* on the bottom which extend towards each other with a space therebetween to allow the jetting of ink mist. A pair of insulating boards 4, on which IDTs 22 are formed, are mounted on respective ones of to the propagation element supporting plates 9*b* and 9*b*. The IDTs 22, which can produce SAWs in the direction towards the crack 12*c*, are formed in parallel, confronting both sides of the propagating surface 12*a* of the propagation element 12. Application of high frequency voltage to the IDTs 22 causes the field coupling of the propagating surface 12*a*, so that the ink led to the edge 12*c* by capillary action is caused to fly in the form of ink mist toward the recording sheet S by the SAWs generated.

Further in FIG. 3, reference character 4*a* designates spacers fixedly mounted on the insulating boards 4 to form a gap of the order of several microns between the propagating surface 12*a* and the IDTs 22; 22*a*, lead wires connected to the 4 IDTs 22; 92, a carriage driving motor; 93, a guide rod for guiding the carriage; and 94, an electrically conductive brush at ground potential installed at the home position to discharge the propagation element 12.

In the above-described embodiment, the propagation element 12, which can be easily damaged, is provided separately from the IDTs 22 so that it can be replaced together with the ink carriage 72 when the ink is used up. Furthermore, the ink cartridge 72 and the propagation element 12 are provided as one unit so that the ink at the edge 12*c* is prevented from drying. In this embodiment, the picture element density can be doubled over that achievable in the first embodiment described above by shifting the IDTs 22 on the right and left insulating boards 4 from each other by half a pitch.

In the above-described embodiment, the crack 12*b* is formed in the propagation element 12 in advance. However, this embodiment may be so modified that the ink cartridge 72 is sealed with only the V-groove 12*d* formed in the propagation element 12 during manufacture, and, in the initial use of the ink cartridge, stress is concentrated at the V-groove 12*d* by SAW to form the crack 12*b* extending to the propagating surface 12*a*.

Specific embodiments of the invention have been described; however, it should be noted that the invention is not limited thereto or thereby. That is, the propagation element, the SAW generating means, etc., can be modified in various manners according to the invention. Such modifications, or other embodiments of the invention, will be subsequently described.

SAW Propagation Element

Examples of the material of the propagation element 1 are 128° Y-cut $LiNbO_3$ single crystal (employed in the above-described embodiment), piezoelectric signal crystals such as $Bi_{12}SiO_{20}$, $BuGeO_{12}$ and $LiTaO_3$, piezoelectric ceramics such as $PBO_3$ and $PbZrO_3$, metal such as Al and Cu, and glass. Isotropic materials such as ceramics, glass and metal are advantageous in economy and in machinability. In order to increase the density of individual waveguides thereby to increase the density of picture elements, anisotropic materials such as piezoelectric single crystals should be used. In order to suppress SAW propagation by the reverse piezoelectric effect, ordinary piezoelectric materials should be used.

Figure 19:
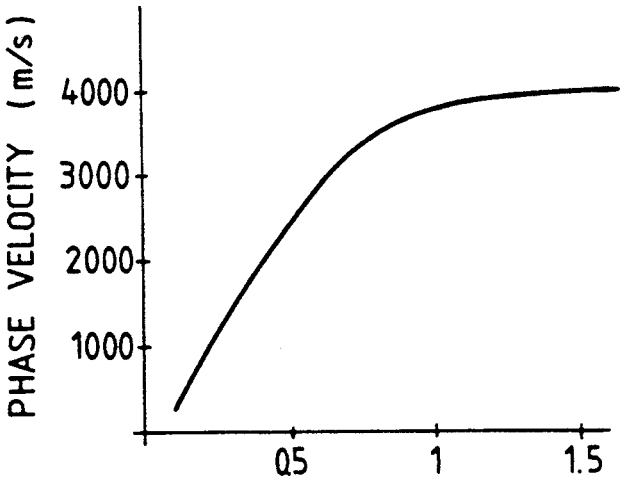
FIG. 19 is a graphical representation indicating exciting wavelength with phase velocity with respect to the thickness of a propagation element.
Figure 20:
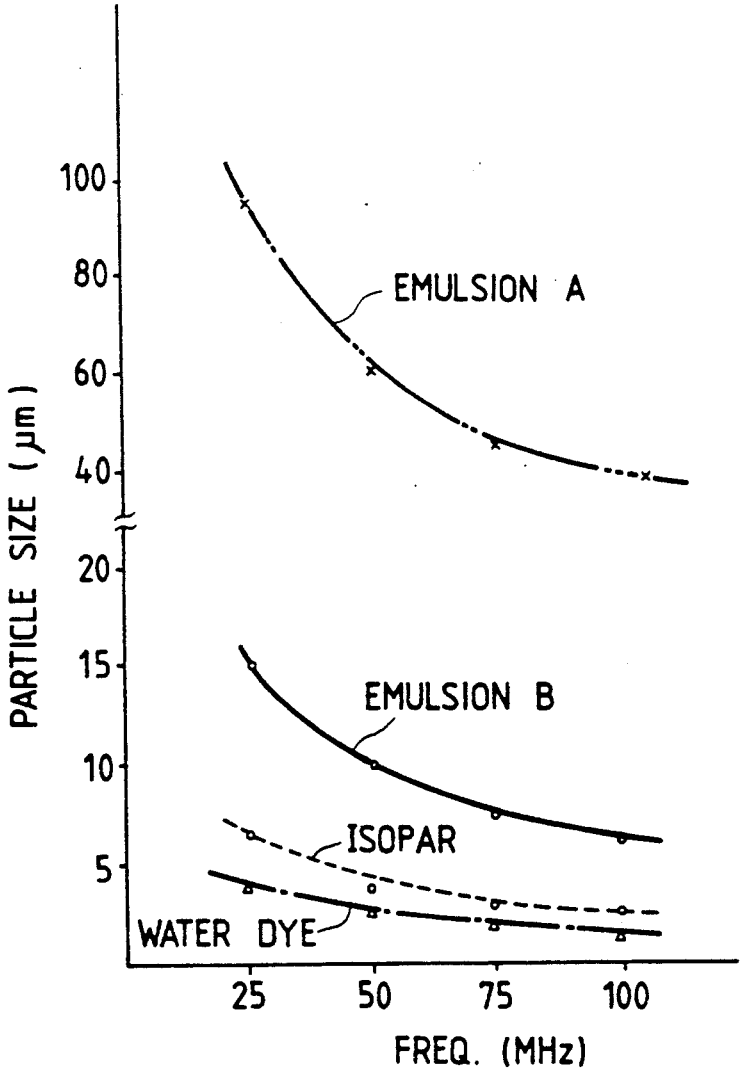
FIG. 20 is a graphical representation indicating the relationships between ink compositions, frequencies and particle sizes.
Figure 21A:
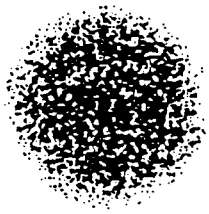
FIGS. 21(*a*) through 21(*c*) are diagrams showing the configurations of dots formed by the printer according to the invention, and FIG. 21(*d*) is a diagram showing the configuration of a dot formed by a conventional ink jet printer.
Figure 21B:
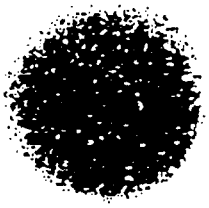
Figure 21C:
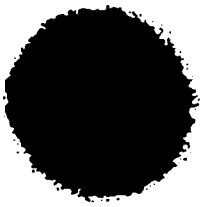
Figure 21D:
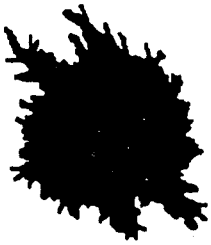

If the thickness to of the propagation element is made larger than the wavelength $\lambda$ of the surface acoustic wave, then as shown in FIG. 19, the propagation velocity v in the propagation element 1 is about 4000 m/sec corresponding to the sound velocity. Therefore, it is necessary to increase the drive frequency f to 40 Mhz, which may cause difficulties such as radio jamming and reduction in the efficiency of the drive circuit. Hence, it is desirable that the thickness t of the propagation element 1 be smaller than the wavelength of the exciting frequency; for instance in the case where the wavelength $\lambda$ is 100 $\mu$m, the thickness t is set to about 400 $\mu$m, the phase velocity v to about 1500 m/sec, and the drive frequency to about 15 Mhz.

In order to avoid diffusion, attenuation or transition of vertical oscillation of SAWs, it is essential that the surface of the propagation element 1 be flat and smooth. As shown in the FIG. 4(*a*), the propagation element 1 may be arcuate if the curvature is sufficiently large with respect to the wavelength $\lambda$. In this case, a space for installation of connectors and other elements can be provided between the propagation element 1 and the recording sheet S.

Furthermore, the propagation element may be modified as shown in FIG. 4(*b*). That is, IDTs 2 are formed by photolithography or the like on the surface of the propagation element 1, which is made of glass, ceramics or metal, and a film of piezoelectric material such as ZnO is formed by sputtering in such a manner as to cover the IDTs 2. In this case, the propagation element 1 itself is not made of a piezoelectric material, and therefore the cost for materials can be greatly reduced, and it is possible to increase the size of the propagation element 1 and to prevent the IDTs 2 from being wetted by ink.

The propagation element 1 may be formed using a material in which the sound velocity is proportional to the depth from the surface. In such a case, all oscillations propagating in the propagation element can be concentrated at the propagation surface 1*a* of the propagation element to form surface acoustic waves.

When the rear surface $Z_1$ of a silicon wafer 4 mm in thickness (FIG. 4(*c*-1)) is maintained at room temperature while the front surface $Z_0$ is exposed in an $O_2$ atmosphere at 800°, the component ratio of the silicon wafer in the direction of thickness is as indicated in FIG. 4(*c*-2), and accordingly the sound velocity in the direction of thickness is as indicated in FIG. 4(*c*-3); that is, it is higher on the side of the rear surface $Z_1$, and lower on the side of the front surface $Z_0$. Hence, when high frequency voltage is applied to a thickness vibrator 61 fixedly mounted on one end face of a propagation element made of such a material, then all the oscillations propagating in the propagation element 1 can be concentrated at the propagating surface 1*a* lower in sound velocity to form surface acoustic waves. In this embodiment, the vertical oscillations of the thickness vibrator 61 can be converted into surface acoustic waves without using wedge pieces 6*a* as shown in FIG. 12, which contributes to simplification of the construction and to increase of the durability.

Ends of the Propagation Element

Forming the end face 1*b* of the propagation element 1 perpendicular to the propagating surface la as shown in FIG. 2 is desirable for simplification of the configuration. However, the end face 1*b* may be so formed that, as shown in the part (a) of FIG. 5, it forms an obtuse angle with the propagating surface 1*a*. In this case, the edge 1 is higher in accuracy and in durability than that of the above-described propagation element.

Furthermore, the end face 1*b* may form an acute angle with the propagating surface 1*a* as shown in FIG. 5(*b*). In this case, the ink mist will jet at an accurate angle; however, it is necessary to slightly round the edge 1*c* because the latter 1*c* is liable to be worn.

FIG. 5(*c*) shows an example of the propagation element employed in the above-described second embodiment (FIG. 3). In the propagation element 1, a crack 1*d* is formed perpendicular to the waveguides to provide an end face 1*b*. In the example, an ink chamber 7 is provided below the crack 1*d* to prevent the ink from drying. The capillary action of the crack 1*d* is utilized to supply ink to the edge 1*c*. The propagation element can suppress the unwanted jetting of ink droplets, as shown in FIG. 2(*b*). Similarly as in the above-described second embodiment, the density of picture elements can be doubled by forming IDTs 2 on the right and left propagation element 1R and 1L formed by the crack 1*d* in such a manner that the IDTs are shifted from one another by half the pitch.

In the case of FIG. 5(*d*), a supporting substrate 5 has a step 5*a*, and a propagation element 1 is mounted on the supporting substrate with its end face 1*b* abutted against the step 5*a*. In this case, the thin propagation element 1 and its edge 1*c* can be reinforced with the supporting substrate 5, and an ink chamber 7 may be formed in the supporting substrate 5.

In a propagation element shown in FIG. 5(*e*), a groove 1*d* is formed in the propagating surface 1*a* in such a manner that it extends across the waveguides. The groove 1*d* is utilized as an ink supplying section. In this case, similarly as in the propagation element shown in FIG. 5(*c*), the density of picture elements can be doubled by forming IDTs 2 on both sides of the groove 1 in such a manner that the IDTs are shifted from one another. In this embodiment, both side walls of the groove may be inclined if necessary.

Specific features of propagation elements shown in the FIGS. 5(*f*) and (*g*) reside in that the ink mist is allowed to jet stably, and it is integrated, as a multi-element, with high concentration.

In the propagation element 1 shown in FIG. 5(*f*), a number of holes 1*f* are formed in a line in such a manner that the line extends across waveguides, and ink mist jetting positions are determined by the edges 1*c* of the holes. As shown in FIG. 5(*f*-1), the hole diameter r: perpendicular to the direction of propagation of the SAW is made less than or equal to the wavelength λ so that the interference which is caused by the reflection of the SAW from the periphery of the hole is suppressed, and the SAW advances towards the center of the hole by diffraction to efficiently transmit the energy to the ink. In addition, the hole diameter $r_2$ parallel to the direction of propagation of the SAW is made one-fourth to three-quarters of the wavelength so that deformation of the hole caused by the phenomenon that the phase of the SAW at the upstream side b of the hole 1*f* is opposite to that of the SAW at the downstream side a of the hole is suppressed. In this embodiment, a color image can be recorded by supplying different color inks to the different holes 1*f*.

In the propagation element shown in FIG. 5(*g*), a series of rectangular or triangular protrusions 1*j* extend from its one end with edges 1*c* between them, thus regulating the width of ink mist jetting therefrom. Therefore, an image is formed stably. In this embodiment, the above-described effect can be enhanced by applying a damping agent to the tops of the protrusions 1*j*.

Propagating Surface

In order to propagate the SAW in a desired direction by suppressing its attenuation, it is necessary to provide a ridge trapezoid or triangular in section or a groove on the surface of the propagation element 1, as disclosed by the publication "Surface Acoustic Wave Engineering", page 86 (published by the Electronic Information Communications Society).

Figure 6A:
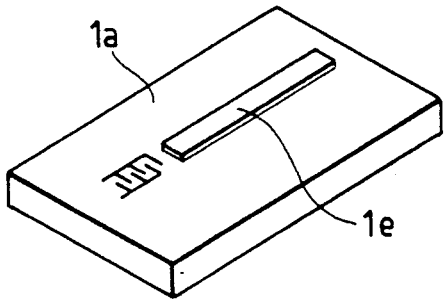
FIGS. 6(*a*) and 6(*b*) are diagrams showing examples of the propagating surface of the propagation element.
Figure 6B:
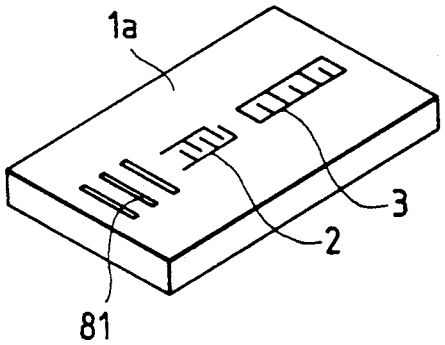

For this purpose, as shown in FIG. 6(*a*), a metal film 1*e* is bonded to the waveguide in the propagating surface, so that the speed of propagation of the SAW in the portion under the film 1*e* of the propagation element 1 is lower than in the other portion. That is, reflection occurs with the SAW due to the speed difference, to lead the SAW while preventing its interference with other SAWs.

The same effect of the above-described wave guide means can be obtained by providing a ladder-shaped induction electrode on the waveguide, as shown in FIG. 6(*b*). A ladder-shaped induction electrode 3 with a gap corresponding to the wavelength of the SAW is formed on the propagating surface 1*a* to electrically connect the portions of the surface of the piezoelectric element which are equal in potential, whereby the directivity and propagation characteristic are improved. The propagation element may have gratings 81 in the end portion of the propagating surface 1*a* which is on one side of the IDTs 2 in a direction opposite to the direction of propagation, the gratings 81 being formed by bonding a metal film to the propagating surface, or by forming a shallow groove in the propagating surface 81, or impinging a material in the propagating surface which changes the material constant of the propagation element near the surface. Due to the presence of the gratings 81, SAWs reflected from the grating 81 are combined with the progressive wave thereby to use the energy more efficiently.

In order to increase the SAW energy to allow the jetting of ink mist, a separation type amplifier or monolithic amplifier, as disclosed by the aforementioned publication "Surface Acoustic Wave Engineering", pages 214 and 215, may be employed. The use of such an amplifier makes it possible to reduce not only the SAW driving power but also the switching power.

Ink and Its Supply

As for the ink, various experiments have been carried out by applying 50 MHz high frequency voltage to the IDTs 2 of the propagation element 1 as shown in FIG. 2. It has been found that, as shown in the following Table 1, the particle size of ink mist can be changed to various values depending on the physical properties of the ink (Table 2).

TABLE 1

| Ink name | Surface tension (dyne/cm) | Viscosity (cp) | Particle size (μm) | IDT cross width (mm) | No. of pairs of IDTs | Drive voltage |
|---|---|---|---|---|---|---|
| Water base dye | 51.8 | 1.27 | 2.50 | 2.0 | 20 | 17.6 |
| Emulsion A | 33.0 | 2.50 | 60.6 | 2.0 | 20 | 27.6 |
| Emulsion B | 36.6 | 1.75 | 10.0 | 0.5 | 20 | 25.1 |
| Isopar (aliphatic saturated hydrocarbon) | 25.0 | 1.85 | 4.00 | 1.0 | 20 | 17.2 |

TABLE 2

| Ink name | Solvent | Coloring Material | Dispersion (%) | Average particle size |
|---|---|---|---|---|
| Water base dye | Water solvent | Water base dye | 2.0 | — |
| Emulsion A | Water solvent | Water base dye + resin | 20.0 | 90 |
| Emulsion B | Water solvent | Oil base dye + resin | 20.0 | 53 |
| Isopar (aliphatic saturated hydrocarbon) | Oil solvent | Oil base dye | 2.0 | — |

Note: The average particle size is that of resin particles in the dispersed solution, and the dispersion is the weight percentage of the resin (solid) (3% of the solid being dye).

Through experiments carried out at different frequencies, the following facts were found:

A water base dry ink, which is small is particular size in the form of mist can have a particle size practical in use even if the frequency is low. Therefore, it is suitable for a wedge type vibrator (described later with reference to FIGS. 12(*a*) and 12(*b*)). An ink of emulsion series large in particle size when formed into mist is suitable for a high frequency Gunn diode operated ink jet printer.

Next, the supply of ink will be described.

In the case of FIG. 5(i) in which the ink supplying end face 1*b* is provided at the front end of the propagation element 1, an ink absorbing material 71 such as cotton or sponge is provided below the end face 1*b*. In the case of FIG. 5(*c*) in which the propagation element 1 has the crack 1*d*, an ink tank 7 is set below the crack 1*d*.

Figure 7:
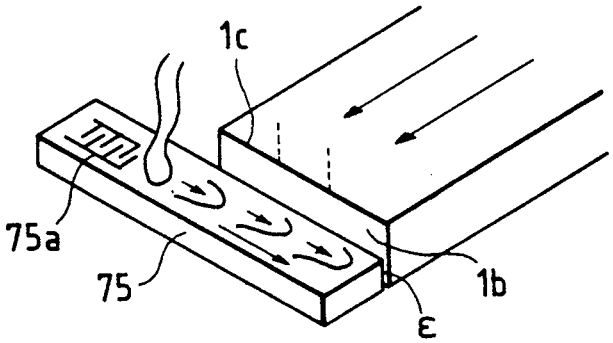
FIG. 7 is a perspective view showing an example of ink supplying means in the invention.

Means for forcibly supplying ink is arranged as shown in FIG. 7. That is, an ink conveying propagation element 75 is provided along the end face 1*b*, and IDTs 75*a* formed on one end portion of the surface of the propagation element 75 produce a SAW in the surface of the latter 75 to supply ink to the lower portion the end face 1*b*. In this case, the ink conveying propagation element 75 and the propagation element 1 are positioned in such a manner that the upper surface of the former propagation element 75 is shifted downward from that of the latter propagation element 1 as much as 0.5 to 3 times the wavelength of the SAW and a slit or gap $\epsilon$ is provided between the former and latter propagation elements 1 and 75, so that a predetermined quantity of ink is supplied to the edge 1*c* during recording.

Figure 8:
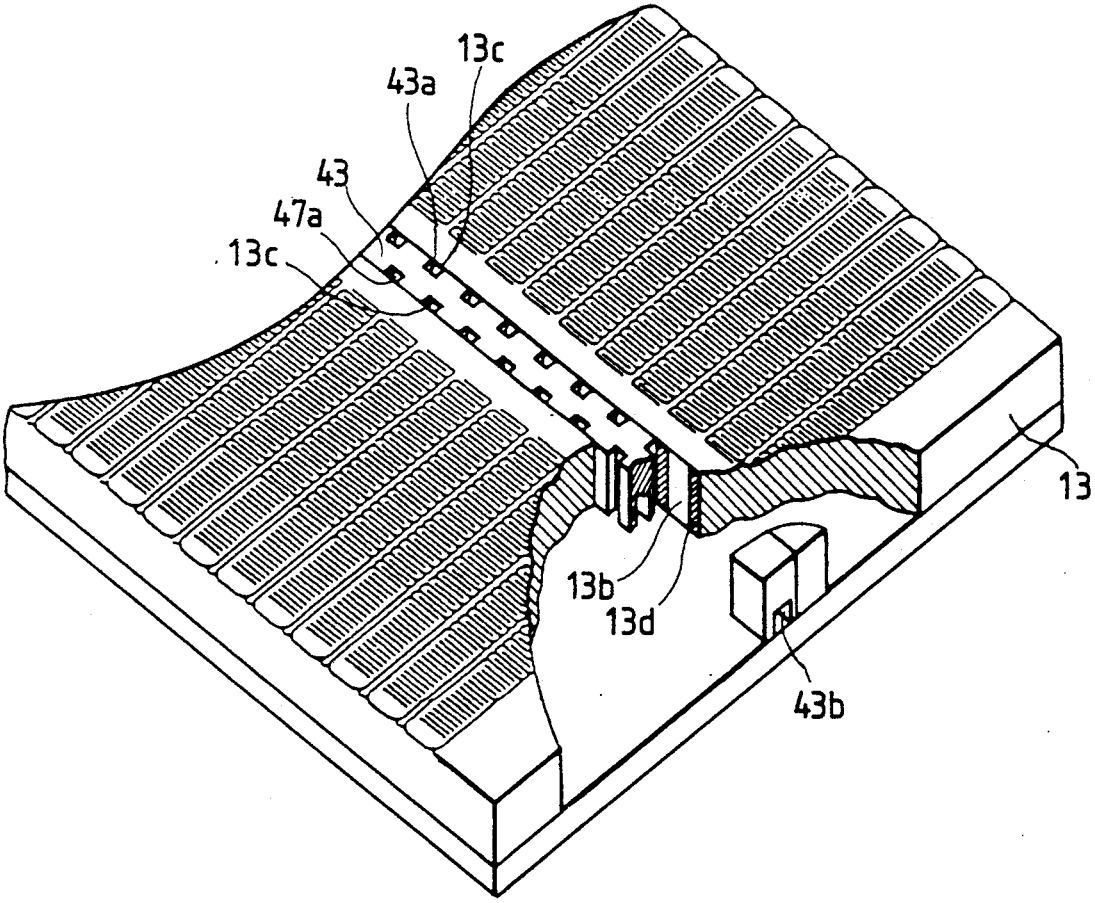
FIGS. 8, 9 and 10 are diagrams showing other more concrete examples of the ink supplying means.

Another embodiment shown in FIG. 8 is designed so that ink mist is allowed to jet stably, and it operates as a multielement to supply ink to the edge with high density.

In the embodiment shown in FIG. 8, a number of metal films 13*d* of chromium or gold are formed on the end face 13*b* of a propagation element 13 in correspondence to SAW propagating paths by photolithography or the like in such a manner that the width of each metal film is smaller than the width of propagation. An ink supplying member 43 of synthetic resin is provided along the end face 13*b* in such a manner as to cover the latter, and in the junction a number of ink grooves 44*a* whose width is smaller than the SAW propagation width are formed in correspondence to the metal films 13*d*. The ink supplied to the ink grooves 43*a* through a common ink supplying path 43*b* is supplied to the edges 13*c* of the propagation element 13 which are provided in correspondence to the propagating paths.

In this embodiment, when compared with the end face 13*b* of the propagation element 13, the surfaces of the metal films 13*d* are wetted better, being smaller in ink contact area. Therefore, the ink is supplied to the edges 13*c* with the width made smaller than the SAW propagation width by the metal films 13*d* and the ink grooves 43. From the edges 13, the ink is caused to jet in the form of ink mist to the recording medium by the action of the SAWs, thus recording uniform dots whose diameter is substantially equal to the above-described width. It has been found through experiments that the range of spread of ink mist is minimum when the metal films 13 and the ink grooves 43 are employed in combination, and even in the case of employment of one of the metal films 13 and ink grooves 43*a*, that is, even when only the metal films 13 are employed or only the ink grooves 43*a* are employed, the range of spread of the ink mist is suppressed, so that the recorded image is high in precision.

Figure 9:
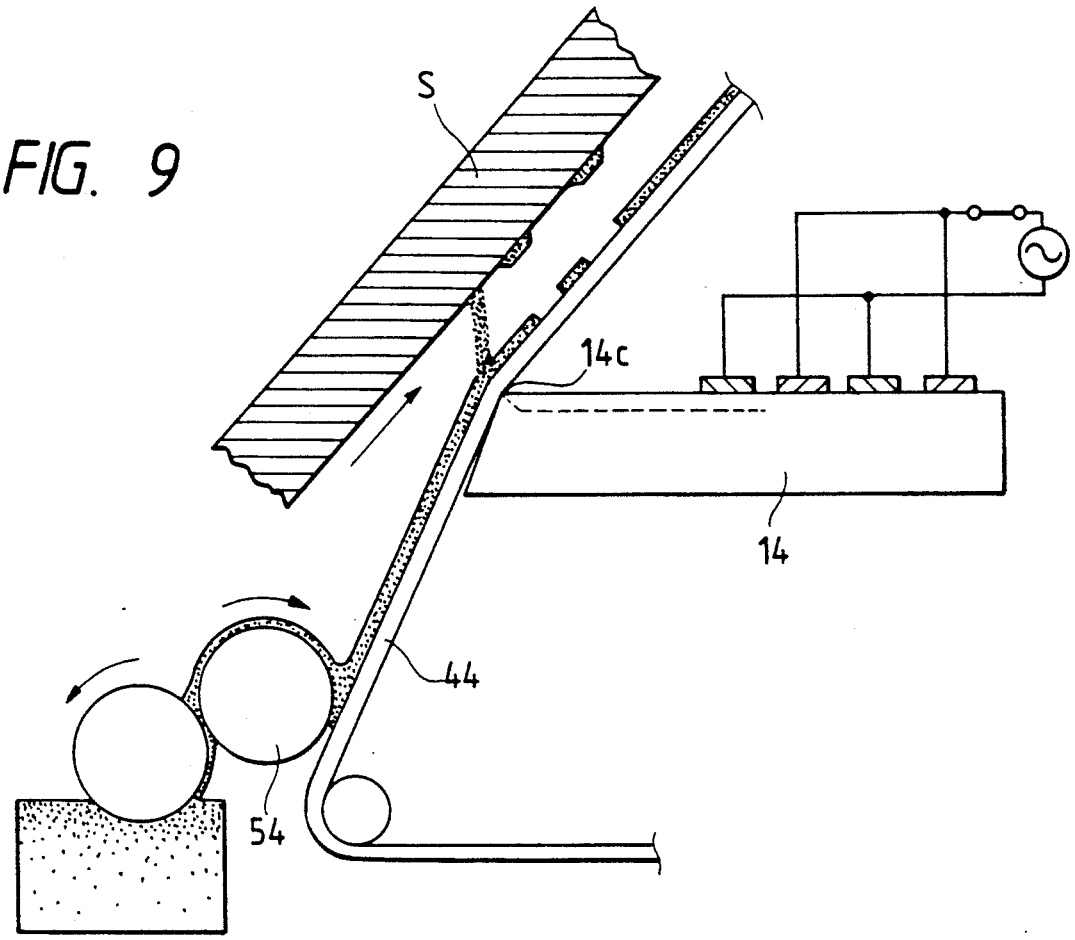

On the other hand, in another embodiment shown in FIG. 9, ink is not brought into contact with the propagation element when the ink is supplied.

In the embodiment shown in FIG. 9, an ink conveying film 44 is run in contact with the edge 14*c* of a propagation element 14 in the same direction and at the same speed as the recording medium S, while ink is applied uniformly to the outer surface of the film 44 with the aid of an ink roller 54, and the ink thus applied is caused to jet, in the form of ink mist, to the surface of the recording medium S by the SAW propagating through the film 44.

As for the ink conveying film, a resin film may be employed whose surface is raised for film thickness regulation, or a porous film may be employed. In addition, a base cloth formed by weaving fibers 30 μm in diameter may be employed into which a macromolecular absorbing agent is impregnated and which is lined with a laminate film. Furthermore, a film incorporating microcapsules of ink 0.1 μm in average particle size may be used. The microcapsules are broken by the SAW to cause the ink in them to jet as ink mist.

Figure 10:
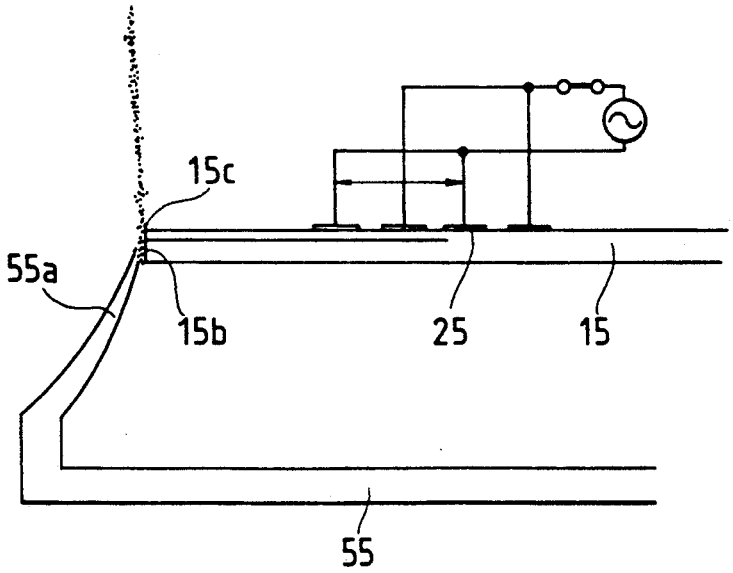
Figure 13A:
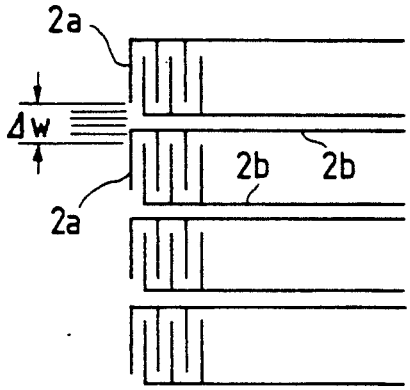
FIGS. 13(*a*) through 13(*f*) are diagrams showing examples of an IDT pattern in the invention.
Figure 13B:
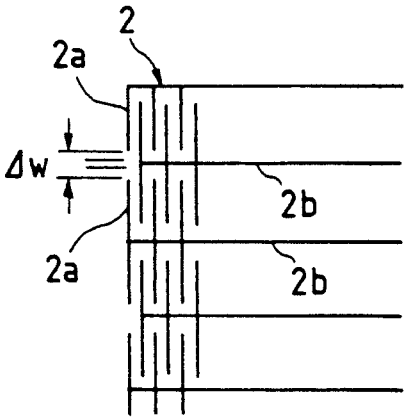
Figure 13C:
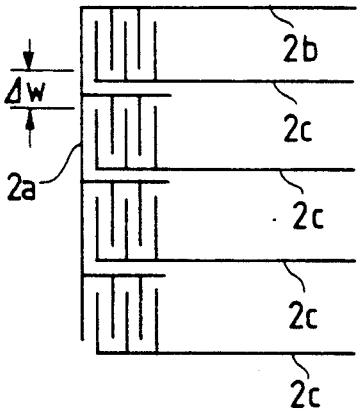
Figure 13D:
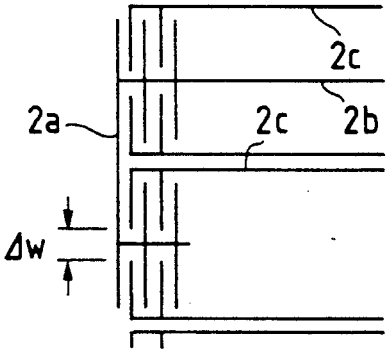
Figure 13E:
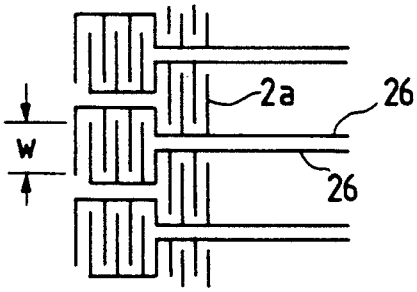
Figure 13F:
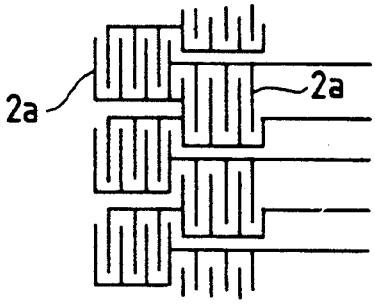

In another embodiment shown in FIG. 10, the ink is not exposed to the air when supplied to the edge of the propagation element.

In the embodiment shown in FIG. 10, an ink tank 55 of synthetic resin has a thin reed piece 55*a* at the front end, and the reed piece 55*a* is held in contact with the end face 15*b* of the propagation element 15 forming a small angle with the end face. The ink is held sealingly in the ink tank 55, and a part reaches the edge 15 due to the capillary action of the gap between the reed piece 55*a* and the end face 15*b* of the propagation element 15. When an AC voltage is applied to the IDTs 25 formed on the propagation element 15, a SAW is produced to momentarily push the reed piece 55*a* to cause the ink at the edge 15*c* to jet as ink mist.

SAW Generating Means

In order to generate SAWs on the propagation surface, the IDT is preferred, and its fundamental arrangement has been described with reference to FIG. 2.

One example of such SAW generating means is as shown in FIGS. 11(*a*-1) and 11(*a*-2). In this example, relatively wide IDTs 2 are formed on the surface of the propagation element 1 made of a piezoelectric material, and switching electrodes 25*a* which correspond in number to picture elements are provided over the propagation element, and a common electrode 25*b* is provided below the latter. A high frequency voltage applied to the wide IDTs 2 is shifted from the resonance point of the latter. Hence, when voltage is applied between the switching electrodes 256 and the common electrode 25*b*, the piezoelectric element is changed in density to coincide the resonance point of the IDTs 2 with the frequency of the high frequency voltage, whereby the switching operation can be achieved with ease, and the density of picture elements can be increased.

Another example of the SAW generating means shown in of FIGS. 11(*b*-1) and 11(*b*-2) concerns the non-contact field coupling in the second embodiment of the invention (FIG. 3). In this example, a flexible insulating plate 41 is mounted through spacers 41*a* on the propagation element 1 made of a piezoelectric material with a gap of several microns between the propagation element and the insulating plate 41. IDTs 2 formed on the confronting surface of the insulating plate 41 generate an electric field to strain the surface of the propagation element 1 thereby to generate a SAW. The SAW generating means thus constructed is advantageous in that only the propagation element 1 liable to be damaged can be replaced when necessary.

The example may be modified so as to be of the separation type of the SAW generating means shown in FIGS. 11(*a*-1) and 11(*a*-2) by providing a common electrode on one inner surface of the insulating plate 41 and switching electrodes on the other inner surface.

The SAW generating means shown in FIGS. 11(*c*-1) and 11(*c*-2) is obtained by further developing the above-described non-contact field coupling type. In the SAW generating means, an insulating element 4 having IDTs 2 on its lower surface is moved along guide rod 93, i.e., parallel to the end face 1*b* of the propagation element 1. In this case, the line head can be formed with considerably simple IDTs.

The SAW generating means shown in FIGS. 11(*d*-1) and 11(*d*-2) operates on the difference of propagation speed. A first propagation element 1-1 having IDTs 1 on its base end region is coupled to a second propagation element 1-2 having an ink chamber 7 below its end face, so that the SAW generated in the first propagation element 1-1 is transmitted to the second propagation element. In this embodiment, depending on the coupling of the first and second propagation elements 1-1 and 1-2, the SAW can be propagated from front surface to front surface (FIG. 11(*a*)), or from rear surface to front surface (FIG. 11(*b*) and 11(*c*)). Furthermore, the degree of freedom in the layout of the head can be increased. In addition, when the propagation velocity of the first propagation element 1-1 is higher than that of the second propagation element 1-2, then the IDTs can be made larger accordingly.

The SAW-generating means of direct excitation type using the IDTs, or comb-shaped electrode transducers have been described; however, the invention is not limited thereto or thereby. That is, the invention may employ SAW generating means of other excitation types.

FIGS. 12(*a*-1) and 12(*a*-2) show SAW generating means of a vertical wave coupling type. The SAW generating means includes a propagation element 1 made of glass, or ceramics, wedge pieces 6*a* of polystyrene mounted on the surface of the base end region of the propagation element 1 with a critical angle $V_C/V_R = \sin\theta$ (where $V_C$ is the velocity of propagation of a vertical wave in the wedge piece, and $V_R$ is the velocity of propagation of SAWs along the surface of the propagation element), and thickness vibrators 6*a* made of a piezoelectric element such as PZT fixedly mounted on the end faces of the wedge pieces 16*a*, respectively. High frequency voltage is applied to the wedge type vibrators 6 thus constructed to produce vertical oscillations, which are applied to the propagation element 1 to generate SAWs in the propagating surface. The wedge type vibrators 6 may be provided for picture elements. In order to generate a uniform SAW in the propagating surface 1*a*, relatively wide wedge type vibrators 61 are provided, as shown in FIG. 12(*b*).

FIGS. 12(*c*-1) and 12(*c*-2) depict SAW generating means of separation type, which is one modification of the SAW generating means described above. The base end portion of a first propagation element 1-1 is fixedly mounted on an L-shaped block 1*h* with the surface held inside on which IDTs are formed. The base end portion of a second propagation element 1-2 having ink tank 7 below its end face is inserted into the space between the L-shaped block 1h and the first propagation element 1-1. The first and second propagation elements 1-1 and 1-2 are coupled to each other through vertical waves produced by the two wedge type vibrators 6 and 6 in such a manner that they are separable from each other.

SAW generating means of Gunn diode excitation type as disclosed by the aforementioned publication "Surface Acoustic Wave Engineering", pages 76 through 78, may be employed in the invention.

Drive Frequency

The drive frequency for a printer is limited to a range of from 20 KHz, which is the upper limit of audible frequency band, to several gigahertz (GHz) at which ink mist is minimum in particle size.

A wedge type vibrator is suitable for a frequency band of lower than 5 MHz in view of the resonance thickness of a piezoelectric element. A propagation element with IDTs is suitable for a frequency band of from 1 MHz to 1 GHz because of the propagation velocity of the SAW (from 1600 m/sec for $Bi_{12}GeO_{20}$ to 4000 m/sec for $LiNbO_3$). An excitation system based on the Gunn effect may be employed for a frequency band of higher than 1 GHz.

It has been found through experiments that picture elements can be formed best when the SAW is excited in a frequency range of around 50 MHz using IDTs, and the following relationships exist between frequencies and various factors:

TABLE 3

| | | Features | | | | |
|---|---|---|---|---|---|---|
| Frequency | System | (1) Circuit design & mfr. | (2) For increasing resolution | (3) SAWs straight advancement | (4) Ink mist particle size | (5) Power increasing |
| 20 kHz - 5 MHz | Wedge type vibrator | Easy | Not suitable | Low | Large | Easy |
| 1 MHz - 1 GHz | IDT | ↓ | ↓ | ↓ | ↓ | ↓ |
| 1 GHz - | Gun diode | Difficult | Suitable | High | Small | Difficult |

IDT Patterns

A typical IDT for generating a SAW on the propagating surface has been already described with reference to FIG. 2. In order to form a printer using an IDT, it is essential to reduce the width of the IDT.

A fundamental IDT is as shown in FIG. 13(*a*). In an IDT shown in FIG. 13(*b*), the feed lines 2b and 1b of adjacent comb-shaped electrodes 2a and 2a forming the IDT are combined into one feed line. The IDT in FIG. 13(*b*) is disadvantageous in that it is low in independence; however it is advantageous in that, in the fundamental IDT, it is necessary to provide a space $\Delta w$ corresponding to the total width of five feed lines (50 μm when the width of a feed line is 10 μm) between adjacent comb-shaped electrodes 2a and 2a, whereas in the case of FIG. 13(*b*), the space may be the total width of three feed line (30 μm), and the density of picture elements can be increased as much.

As shown in FIG. 13(*c*), one common electrode 2b and four signal electrodes 2c form one group. Similarly as in the fundamental IDT, it should be spaced a distance corresponding to the total width of five feed lines from its adjacent comb-shaped electrode. However, the IDT is advantageous in that the number of feed lines can be minimized.

As indicated in FIG. 13(*d*), signal electrodes 2c are arranged on both sides of a common electrode 2b. The space between adjacent comb-shaped electrodes can be reduced to the value corresponding to the total width of three feed lines, and the density of picture elements can be increased as much.

In order to decrease the width of an IDT, it is necessary to reduce its cross width W. However, naturally the reduction of the cross width W is limited. Let us consider the case where, for instance, a SAW is excited at 10 MHz with the efficiency of the drive circuit taken into account. If, in this case, the sound velocity c is set to 4000 m/sec, then the wavelength $\lambda$ is 400 μm, and therefore the cross width W should be set to 1.2 mm or larger. Thus, it is impossible for ordinary means to integrate the multi-element with high density.

This difficulty has been overcome by an IDT shown in of FIG. 13(*e*). In this case, comb-shaped electrodes 2a are arranged in two stages, front and rear stages, so that, with the necessary cross width W maintained, the space between adjacent waveguides is eliminated, whereby the density of picture elements is made higher than in the case where the comb-shaped electrodes are arranged in one stage. In the case of FIG. 13(*f*), adjacent feed lines 2b and 2b are combined into one feed line to increase the density of picture elements.

Figure 14A:
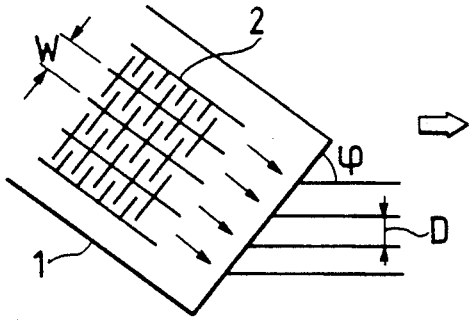
FIGS. 14(*a*) through 14(*c*) are diagrams showing examples of density increasing means in the printer of the invention.
Figure 14B:
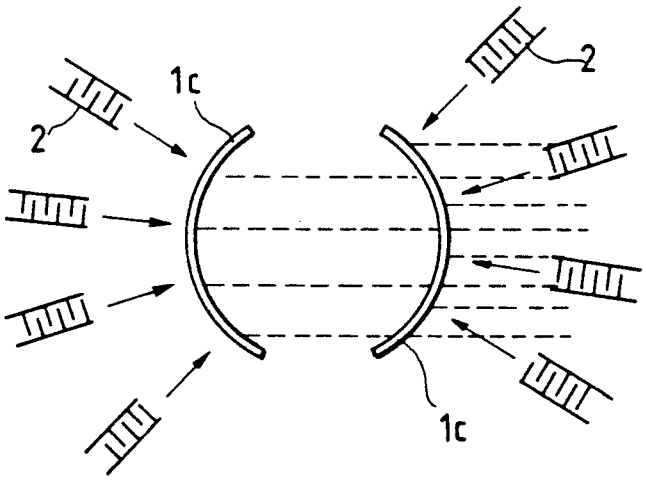
Figure 14C:
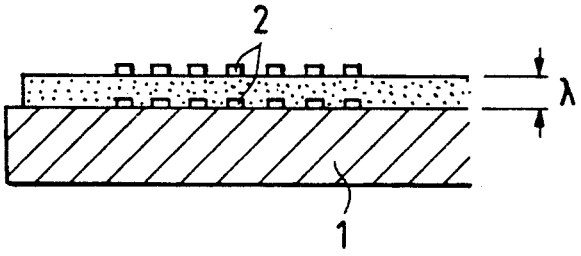

Another means for increasing the density of picture elements is shown in FIG. 14(*a*). In this case, the propagation element 1 is inclined an angle $\phi$ with respect to the direction of main scanning. Adjustment of the drive timing of the IDTs 2 makes it possible to reduce the distance between adjacent picture elements to $w \times \sin \phi$, where w is the IDT width.

In the case of FIG. 14(*b*), edges 1c are made accurate, and IDTs 2 are radially arranged around the arcuate edges 1c. In this case also, the distance between adjacent picture elements can be decreased.

For the same purpose, in the case of FIG. 14(*c*), two layers of IDTs 2 and 2 are formed on the propagation element 1 in such a manner that the two layers are spaced from each other a distance corresponding to the wavelength $\lambda$ in the widthwise direction with the IDTs of one layer shifted from those of the other layer by half the pitch.

Selective Generation, Suppression and Control of the SAW

In general, for generating SAWs selectively, as shown in FIG. 4(*b*), the IDTs 2 are connected through the respective switches SW to the high frequency source AC.

Figure 15A:
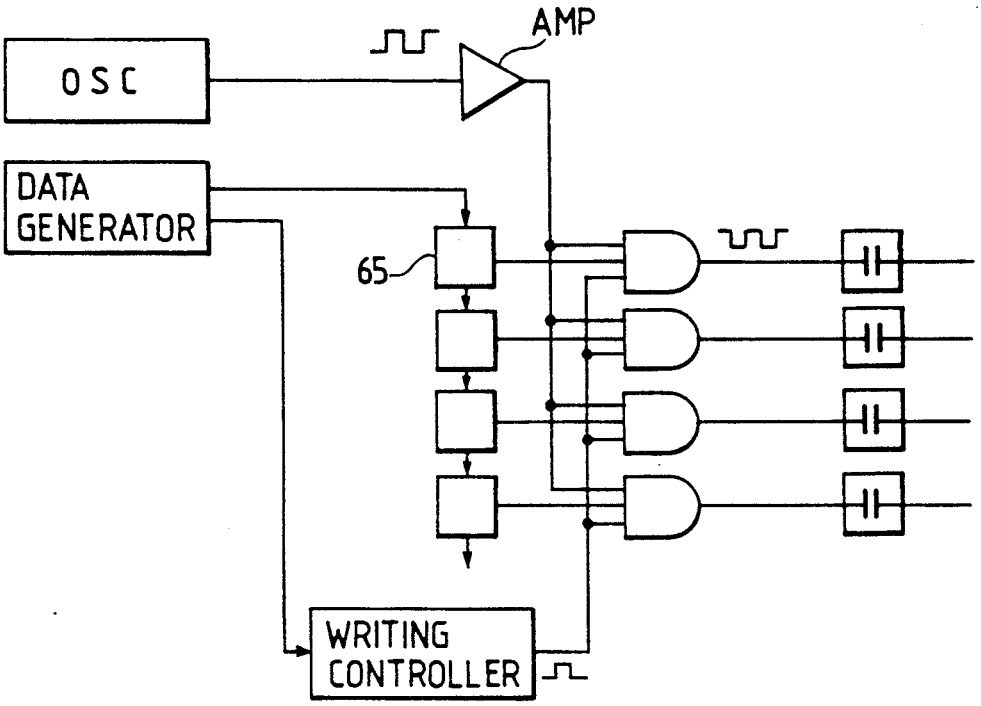
FIGS. 15(*a*) and 15(*b*) are diagrams showing examples of means for selectively generating SAWs in the invention.
Figure 15B:
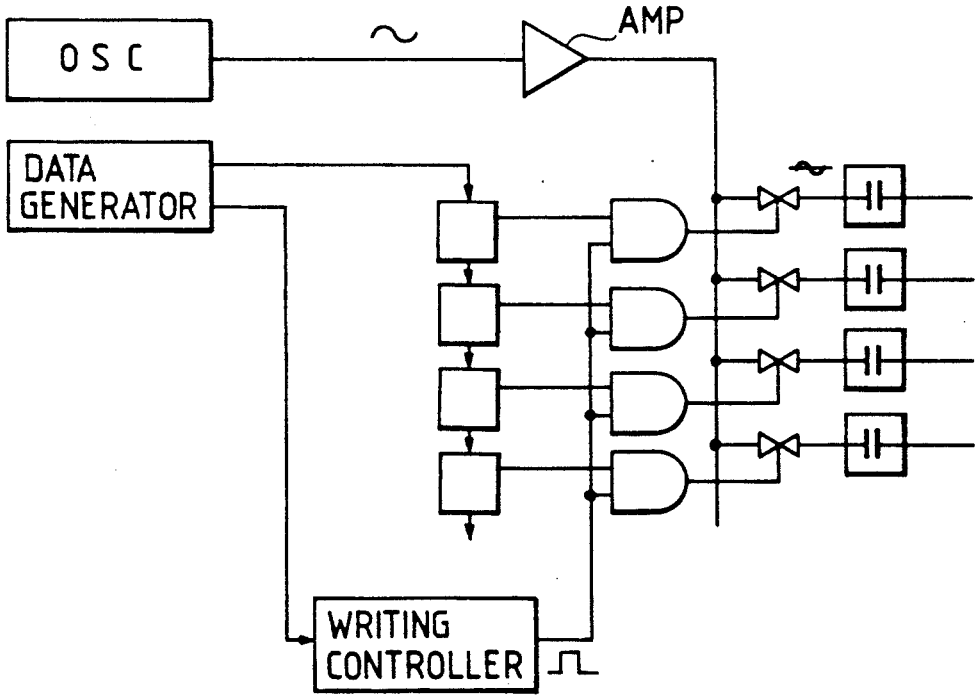
Figure 16A:
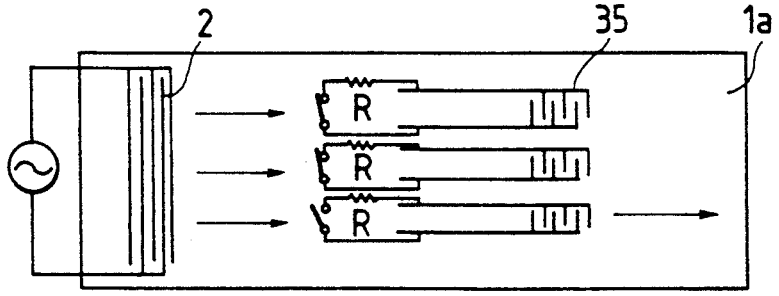
FIGS. 16(*a*) through 16(*d*) are diagrams showing examples of selectively suppressing means in the invention.
Figure 16B:
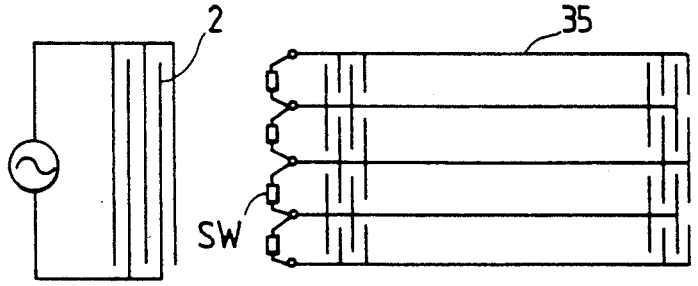
Figure 16C:
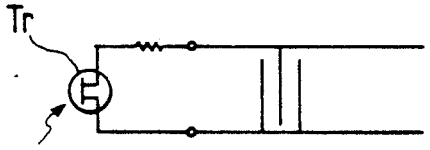
Figure 16D:
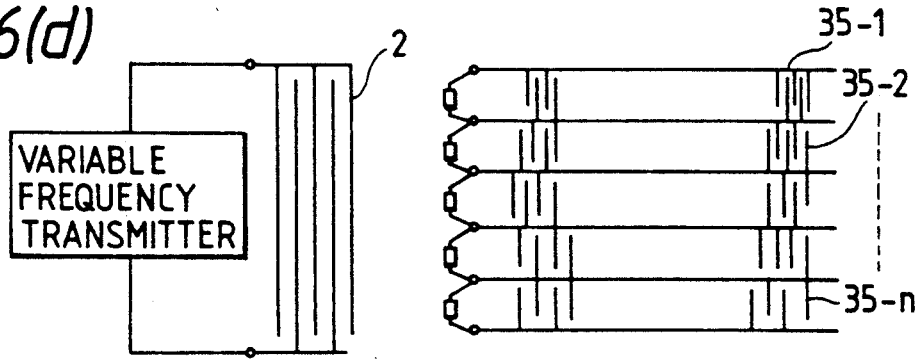

FIGS. 15(*a*) and 15(*b*) show examples of the means for selectively generating SAWs, which are inclusive of a single oscillator and an amplifier. That is, circuits are formed as shown in FIGS. 15(*a*) and 15(*b*) depending on the waveshape of the driving signal employed, i.e., depending on whether a square wave is used to drive IDTs or whether a sinusoidal wave is used to drive the IDTs. In these circuits, the recording image data formed by a data forming section and stored in a group of shift registers 65 sequentially and a pulse from a write control section are ANDed to perform a switching operation. The circuit shown in FIG. 15(*a*) is advantageous in that the oscillation circuit and the switching circuit can be simplified; and the circuit shown in FIG. 15(*b*) is advantageous in that it is noiseless, and that, when an amplitude-modulated wave is employed, the quantity of ink mist jetting per unitary time can be changed, thereby to record images rich in gradation.

FIGS. 16(*a*) through 16(*d*) show examples of the SAW generating means in which a relatively wide IDT 2 or a wedge type vibrator (cf. FIG. 12(*b*)) is employed to produce a SAW in the whole propagating surface 1*a*, and the propagation of the part of the SAW which is unnecessary for recording is suppressed by comb-shaped electrodes 35.

A fundamental example of the SAW generating means is as shown in FIG. 16(*a*). Suppressing comb-shaped electrodes 35 are formed on respective waveguides, and resistors R are connected to the comb-shaped electrodes 35, so that in each waveguide the unnecessary energy induced by the reverse piezoelectric effect is consumed as Joule heat. In the SAW generating means, the comb-shaped electrodes not only suppress the propagation of the unnecessary parts of SAWs, but also isolate the waveguides from one another, and therefore can prevent the leakage of SAWs from the outside.

In the SAW generating means shown in FIG. 16(*b*), with the aid of switching elements SW provided for comb-shaped electrodes 35, the impedances of the latter 35 are changed to reflect SAWs. Therefore, the SAW generating means is advantageous in that the consumption of energy is less, and the circuit may be miniaturized.

The above-described switches or switching elements may be a switching transistor as shown in FIG. 16(*c*) which is operated by light.

In the SAW generating means shown in FIG. 16(*b*), n suppressing comb-shaped electrodes 35-1 through 35-n are formed on respective waveguides, which electrodes are different in the tooth pitch from one another so that their resonance frequencies are gradually changed from $f_l$ to $f_n$. Also, n different high frequency voltages ranging in frequency from $f_l$ to $f_n$ are selectively applied to a relatively wide IDT 2 or wedge type vibrator by a variable frequency generator. In the SAW generating means, a SAW is propagated only from the suppressing comb-shaped electrode 35 which resonates at the frequency outputted by the frequency generating section. Hence, the SAW generating means is advantageous in that the number of SAW generating sections, and accordingly the number of drive circuits, can be reduced by a factor of 1/n, and a time division drive can be employed.

In addition, a SAW generating means may be formed in which a bias SAW generating wide IDT is formed on the whole propagating surface, and a number of SAW generating IDTs are formed in front of the wide IDT which operate according to recording signals. In this case, the bias SAW generating IDT high in efficiency provides a larger part of the energy required for jetting ink mist, and therefore the energy is required for controlling the generation of the recording SAWs is greatly reduced.

Figure 17:
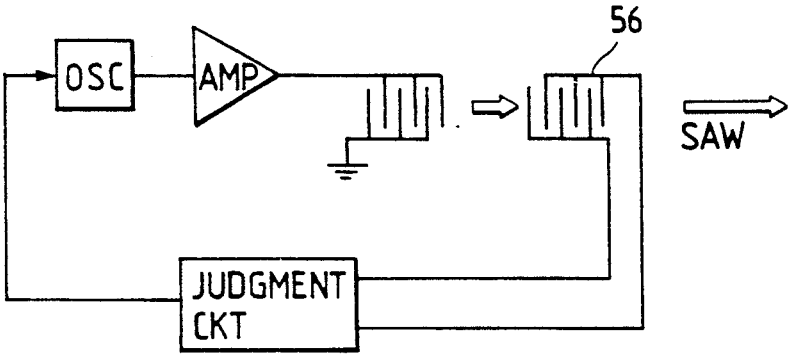
FIG. 17 is a diagram showing an example of SAW controlling means.

On the other hand, in order to cause ink mist to jet from the edge 1*c* of the propagation element 1 as required, it is necessary to control the magnitude of the SAW. For this purpose, there provided is a control circuit as shown in FIG. 17. In the control circuit, a comb-shaped electrode 56 is provided on the end portion of a waveguide, and the output voltage of the comb-shaped electrode 56 is compared with a reference value in a decision circuit. The difference between the output voltage of the comb-shaped electrode and the reference value, i.e., the output signal of the decision circuit, is utilized to control the output of an oscillator OSC or amplifier AMP.

Additional Constitution

The SAWs propagating along the propagation element 1 include an unwanted SAW which propagates in the opposite direction. In order to absorb or reflect the unwanted SAW, the damping element 8 or the grating 81 is provided behind the IDTs 2, or a grating 81 as described with reference to FIG. 1 and FIG. 6(*b*) is employed.

Figure 18:
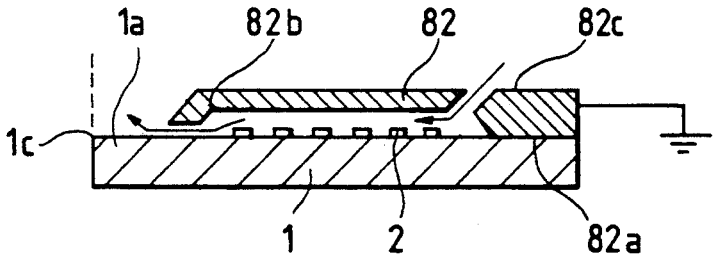
FIG. 18 is a sectional view showing an example of an additional mechanism in the printer of the invention.

In SAW generating means shown in FIG. 18, a damping element 82 for absorbing the above-described unwanted SAW has a function of preventing an IDT 2 from being wetted. An air introducing hole 82*c* is formed in the base end portion 82*a* of the damping element 8 which is so formed as to cover the IDT 2. The base end portion 82*a* of the damping element 82 is fixedly mounted on the propagation element 1 behind the IDT 2, and the front end portion 82*b* of the damping element 82 is confronted with the edge 1*c* with a slight gap therebetween. In the SAW generating means, the propagation of the unwanted SAW is cut by the damping element 82, and a weak air stream introduced inside the damping element 82 through the air introducing hole 82 is caused to flow out through the small gap formed at the front end 82*b* thereby to prevent the influx of ink. In addition, if the damping element 82 is made of metal, radiation of unwanted electromagnetic waves can be prevented by grounding the damping element.

It goes without saying that the SAW generating means described with reference to FIGS. 4 through 18 can be used individually or in combination.

While preferred embodiments of the invention have been described, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A nozzleless ink jet ejecting apparatus for a nozzleless ink jet printer, said nozzleless ink jet ejecting apparatus comprising:

a non-immersed propagation element having an edge to which ink is supplied and a propagating surface for leading a surface acoustic wave to said edge; and surface acoustic wave generating means for generating a surface acoustic wave in said propagating surface.

2. The nozzleless ink jet ejecting apparatus as claimed in claim 1, in which said propagation element has edges to which ink is supplied provided for respective propagation paths on said propagation surface, the width of each edge being smaller than the propagation width of the respective surface acoustic wave.

3. The nozzleless ink jet ejecting apparatus as claimed in claim 1, in which said propagation element has a crack extending across said propagating surface, and an edge of said crack is employed as said edge.

4. The nozzleless ink jet ejecting apparatus as claimed in claim 1, in which said propagation element has an end face to which ink is supplied by surface tension, said end face forming an angle with respect to said propagating surface.

5. The nozzleless ink jet ejecting apparatus as claimed in claim 2, in which said propagation element has an end face to which ink is supplied by surface tension, said end face forming an angle with respect to said propagating surface.

6. The nozzleless ink jet ejecting apparatus as claimed in claim 3, in which said propagation element has an end face to which ink is supplied by surface tension, said end face forming an angle with respect to said propagating surface.

7. The nozzleless ink jet ejecting apparatus as claimed in claim 1, further comprising a belt-shaped ink bearer in sliding contact with said edge 50 that said ink bearer is movable in a direction of movement of a recording medium.

8. The nozzleless ink jet ejecting apparatus as claimed in claim 1, in which said propagation element is longer than a printing region of a recording medium and is arranged near a platen.

9. The nozzleless ink jet ejecting apparatus as claimed in claim 1, further comprising ink collecting means disposed in front of said edge for collecting excess ink droplets.

10. The nozzleless ink jet ejecting apparatus as claimed in claim 1, in which said propagation element and surface acoustic wave generating means are movably arranged in a recording region.

11. The nozzleless ink jet ejecting apparatus as claimed in claim 1, in which said surface acoustic wave generating means comprises at lest one pair of comb-shaped teeth-interleaved electrodes formed on said propagating surface.

12. The nozzleless ink jet ejecting apparatus as claimed in claim 1, in which said surface acoustic wave generating means comprises at least one wedge-shaped vibrator.

13. The nozzleless ink jet ejecting apparatus as claimed in claim 1, further comprising a bias exciting wide surface acoustic wave generating means, in which said bias exciting wide surface acoustic wave generating means and a plurality of said surface acoustic wave generating means operating according to recording signals are arranged on said propagating surface.

14. The nozzleless ink jet ejecting apparatus as claimed in claim 11, further comprising a bias exciting wide surface acoustic wave generating means, in which said bias exciting wide surface acoustic wave generating means and a plurality of said surface acoustic wave generating means operating according to recording signals are arranged on said propagating surface.

15. The nozzleless ink jet ejecting apparatus as claimed in claim 12, further comprising a bias exciting wide surface acoustic wave generating means, in which said bias exciting wide surface acoustic wave generating means and a plurality of said surface acoustic wave generating means operating according to recording signals are arranged on said propagating surface.

16. The nozzleless ink jet ejecting apparatus as claimed in claim 1, further comprising a wide surface acoustic wave generating means and a plurality of suppressing means for attenuating parts of a surface acoustic wave generated by said wide surface acoustic wave generating means and which propagate in directions other than a desired direction.

17. The nozzleless ink jet ejecting apparatus as claimed in claim 11, further comprising a wide surface acoustic wave generating means and a plurality of suppressing means for attenuating parts of a surface acoustic wave generated by said wide surface acoustic wave generating means and which propagate in directions other than a desired direction.

18. The nozzleless ink jet ejecting apparatus as claimed in claim 12, further comprising a wide surface acoustic wave generating means and a plurality of suppressing means for attenuating parts of a surface acoustic wave generated by said wide surface acoustic wave generating means and which propagate in directions other than a desired direction.

19. A nozzleless ink jet ejecting apparatus for a nozzleless ink jet printer, said nozzleless ink jet ejecting apparatus comprising:

a non-immersed propagation element having a propagating surface for leading a surface acoustic wave to an edge thereof and an end face for leading ink to said edge by surface tension; and surface acoustic wave generating means which is separate from said propagation element, said surface acoustic wave generating means being coupled to said propagation element.

20. The nozzleless ink jet ejecting apparatus as claimed in claim 19, in which said propagation element is coupled to said surface acoustic wave generating means so that said propagation element is separable from said surface acoustic wave generating means.

21. The nozzleless ink jet ejecting apparatus as claimed in claim 1, wherein said propagation element is exposed to ambient air.

22. The nozzleless ink jet ejecting apparatus as claimed in claim 19, wherein said propagation element is exposed to ambient air.

23. A nozzleless ink jet printer for jetting ink particles onto a recording medium, said nozzleless ink jet printer comprising a nozzleless ink jet ejecting apparatus and a platen for positioning the recording medium proximate to said ejecting apparatus, wherein said nozzleless ink jet ejecting apparatus comprises:

a non-immersed propagation element having an edge to which ink is supplied and a propagating surface for leading a surface acoustic wave to said edge; and surface acoustic wave generating means for generating a surface acoustic wave in said propagating surface.

* * * * *